US006012309A

United States Patent [19]

Liu

[11] Patent Number: 6,012,309

[45] Date of Patent: Jan. 11, 2000

[54] PAD LOCK WITH RELIABLE CHANGE OF CODE NUMBER

[76] Inventor: Tien-Kao Liu, 1st Floor, No. 22, Lane 5, Ta Lian Road, Pintong, Taiwan

[21] Appl. No.: 09/252,048

[22] Filed: Feb. 17, 1999

[51] Int. Cl.[7] ..... E05B 37/02

[52] U.S. Cl. ..... 70/25; 70/312; 70/320; 70/322

[58] Field of Search ..... 70/22, 24–29, 70/311, 312, 320–322

[56] References Cited

U.S. PATENT DOCUMENTS

| | | | |
|---|---|---|---|
| 1,028,754 | 6/1912 | Lovett | 70/312 |
| 1,964,936 | 7/1934 | Denerich | 70/312 |
| 2,114,073 | 4/1938 | Denerich | 70/312 |
| 2,853,868 | 9/1958 | Vahlstrom | 70/24 |
| 3,419,893 | 12/1968 | Vahlstrom | 70/24 |
| 3,592,027 | 7/1971 | Wako | 70/312 X |
| 3,983,724 | 10/1976 | Foote | 70/25 |
| 4,899,559 | 2/1990 | Chern | 70/312 X |
| 5,396,785 | 3/1995 | Chen | 70/312 X |
| 5,746,075 | 5/1998 | Yang | 70/312 X |

FOREIGN PATENT DOCUMENTS

| | | | |
|---|---|---|---|
| 986744 | 4/1976 | Canada | 70/25 |

*Primary Examiner*—Lloyd A. Gall
*Attorney, Agent, or Firm*—Alan Kamrath; Oppenheimer, Wolff & Donnelly, LLP

[57] ABSTRACT

A pad lock includes an outer casing, a lock main body, and a shackle. A stem is slidably mounted in the lock main body. Several number wheels are rotatably mounted around the stem. Also rotatably mounted around the stem are several retaining sleeves each being releasably engaged with an associated number wheel to rotate therewith. A lever member includes a first end for releasably engaging two pin members to retain the shackle in a locked status. The lever member includes a second end with a number of tongues for engaging with the retaining sleeves. A positioning member is formed on the second end of the lever member. A safety pin is mounted to the lever member to assure the positioning member in a position that prevents setting of a new code when any one of the number wheels is not in the correct position for unlocking.

2 Claims, 8 Drawing Sheets

PAD LOCK WITH RELIABLE CHANGE OF CODE NUMBER

BACKGROUND OF THE INVENTION

1. Field of the Invention

The present invention relates to a pad lock that assures reliable change of the code number.

2. Description of the Related Art

A typical pad lock 7 is shown in FIG. 6 of the drawings and includes an outer casing 71, a lock main body 72, and a shackle 73. The shackle 73 includes a longer section and a shorter section that are respectively received in two receptacles 720 in outer casing 71. The longer and shorter sections of the shackle 73 include aligned notches 731. The longer section includes a spring 732 mounted around a reduced end section 733 thereof that has a distal end 734 of a diameter greater than the reduced end section 733. The spring 732 bears against a retaining inner annular flange 711 in one of the receptacles.

The lock main body 72 is mounted in the outer casing 71 and includes a stem 721 slidably mounted therein. An end block 722 is threadedly engaged with a threaded end of the stem 721. Several number wheels 723 are rotatably mounted around the stem 721. Also rotatably mounted around the stem 721 are several retaining sleeves 725 each of which includes a key 726 releasably engaged with a toothed hole 724 of an associated number wheel 723 to rotate therewith. Each retaining sleeve 725 further includes an enlarged circular end with a circular section and a rectilinear section.

Two pin members 712 are mounted in the outer casing 71, and a spring 710 is provided to bias the pin members 712 to respectively engage with the notches 731 of the shackle 73 and thus retain the shackle 73 in a locked status.

A lever member 713 is mounted in the lock main body 71. The lever member 713 includes a first end 715 and a number of spaced tongues 716 formed on a second end thereof The second end of the lever member 713 further includes a positioning member 717 formed thereon.

If any one of the number wheels 723 is not in the unlocking position (i.e., the code number is not matched), at least one tongue 716 will bear against the circular section of the enlarged circular end and thus retain the first end 715 of the lever member 713 in a position between the pin members 712. Thus, the pin members 712 are moved outwardly to engage with the notches 731, respectively. The positioning member 717 is in a position that prevents from axial movement of the retaining sleeves 725 and the stem 721, as the positioning member 717 stops axial movement of the end block 722.

When all of the number wheels 723 are in the unlocking positions (i.e., the code number is matched), the tongues 716 bear against the rectilinear sections of the retaining sleeves. The first end 715 of the lever arm 713 disengages from the pin members 712 such that the shackle 73 moves upwards under the action of the spring 732 and thus disengages from the pin members 712. It is appreciated that the positioning member 717 is in a position that allows axial movement of the retraining sleeves 725 and the stems 721. If the user wants to set a new code number, he/she may insert an elongated member 80 (see FIG. 6) via an opening 718 of the outer casing 71 to move the stem 721 and the retaining sleeves 725 axially. The key 726 on each retaining sleeve 725 disengages from the associated number wheel 723 and thus allows free rotation of the number wheel 723. Thus, the user may set the number wheels 723 to the required new code number. The elongated member 80 is removed after setting of the new code number, and the retaining sleeves 725 and the stem 721 return to their initial positions under the action of a spring (727). The key 726 of each retaining sleeve 725 re-engages with the associated number wheel 723. Accordingly, the pad lock can be unlocked by a new code number from now on.

Referring to FIG. 7, the lower end of the spring 732 is inclined and thus may be stuck in the inner annular flange 711. In this case, the spring 732 might be twisted and thus looses its elasticity if the shackle 73 is forcibly turned when the lower end of the spring 732 is stuck.

Referring to FIG. 8, the shackle 73 might be tilted such that the enlarged distal end 734 of the shackle 73 exerts an axial force to the end block 722 of the stem 721. As a result, the code number of the pad lock could be inadvertently changed even if any one of the number wheels 723 is turned and the user is not aware of this situation.

Referring to FIG. 9, if the pad lock is in an unlocked status and if the leftmost number wheel 723 is inadvertently rotated and thus does not correspond to the correct code number, the associated tongue 716 is lifted such that the positioning member 717 is moved and thus cannot prevent axial movement of the stem 721 and the retaining sleeves 725. As a result, a change in the code number can be proceeded when the number wheels 723 are not in the positions corresponding to the correct code number. The user will be confused, as the number shown by the number wheels is not the correct code number after the code number changing procedure.

The present invention is intended to provide an improved pad lock that mitigates and/or obviates the above problems.

SUMMARY OF THE INVENTION

In accordance with a first aspect of the invention, a pad lock comprises:

an outer casing including two receptacles, a periphery that defines one of the receptacles including a retaining annular flange formed thereon, the retaining annular flange includes an upper end wall and a lower end wall a shackle including a longer section and a shorter section respectively received in the receptacles of the outer casing, at least one of the longer section and the shorter section including a notch defined therein, the longer section of the shackle including a reduced end section extended through the retaining annular flange, the reduced end section having an enlarged distal end bearing against the lower end wall;

a spring mounted around the reduced end section of the longer section of the shackle and including a lower end, the spring biasing the shackle upwardly to an unlocked status, a protective member secured to the upper end wall of the retaining annular flange, the protective member including a notch through which the reduced end section of the longer section of the shackle is rotatably extended, the protective member further including a guiding section that guides the lower end of the spring away from the retaining annular flange, at least one pin member mounted in the outer casing, means for biasing said at least one pin member to engage with the notch of the shackle to retain the shackle in a locked status, a stem slidably mounted in the outer casing, a plurality of number wheels rotatably mounted around the stem, a plurality of retaining sleeves mounted around the stem, each said retaining sleeve being releasably engaged with an associated said number wheel to rotate therewith, a lever member including a first end releasably engaged with said at least one pin member to retain said at least one pin member in a position that engages with the notch of the shackle, the lever member further including a second end having a plurality of tongues, each said tongue being engaged with at least one of said retaining sleeves, the lever member further including a positioning member formed at the second end thereof, wherein the protective member prevents the enlarged distal end of the longer section of the shackle from engaging with the stem.

In accordance with a second aspect of the invention, a pad lock comprises:

an outer casing including an inner wall and two receptacles, a shackle including a longer section and a shorter section respectively received in the receptacles of the outer casing, at least one of the longer section and the shorter section including a notch defined therein, means for biasing the shackle upwardly to an unlocked status, at least one pin member mounted in the outer casing, means for biasing said at least one pin member to engage with the notch of the shackle to retain the shackle in a locked status, a stem slidably mounted in the outer casing, a plurality of number wheels rotatably mounted on the stem, a plurality of retaining sleeves mounted on the stem, each said retaining sleeve being releasably engaged with an associated said number wheel to rotate therewith, a lever member including a first end releasably engaged with said at least one pin member to retain said at least one pin member in a position that engages with the notch of the shackle, the lever member further including a second end having a plurality of tongues, each said tongue being engaged with at least one of said retaining sleeves, the lever member further including a positioning member formed at the second end thereof, the lever member including a hole defined in a lateral side thereof that is distal to the positioning member, a safety pin having a lower end anchored in the hole of the lever member and an upper end, wherein when any one of the number wheels is not in its unlocking position, the tongue engaged with the associated retaining sleeve is retained in a first position such that first end of the lever member retains said. at least one pin member to engage with the notch of the shackle while the upper end of the safety pin engages with and thus stopped by the inner wall of the outer casing to retain the positioning member in a position that prevents from axial movement of the stem and the retaining wheels to thereby prevent from setting of a new code number, and wherein when all of the number wheels are in their unlocking positions, each said tongue engaged with the associated retaining sleeve is retained in a second position such that the first end of the lever member disengages from said at least one pin member, and the shackle moves upwardly to the unlocked position, while the positioning member is in a position that allows axial movement of the stem and the retaining sleeves to allow setting of the new code number.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
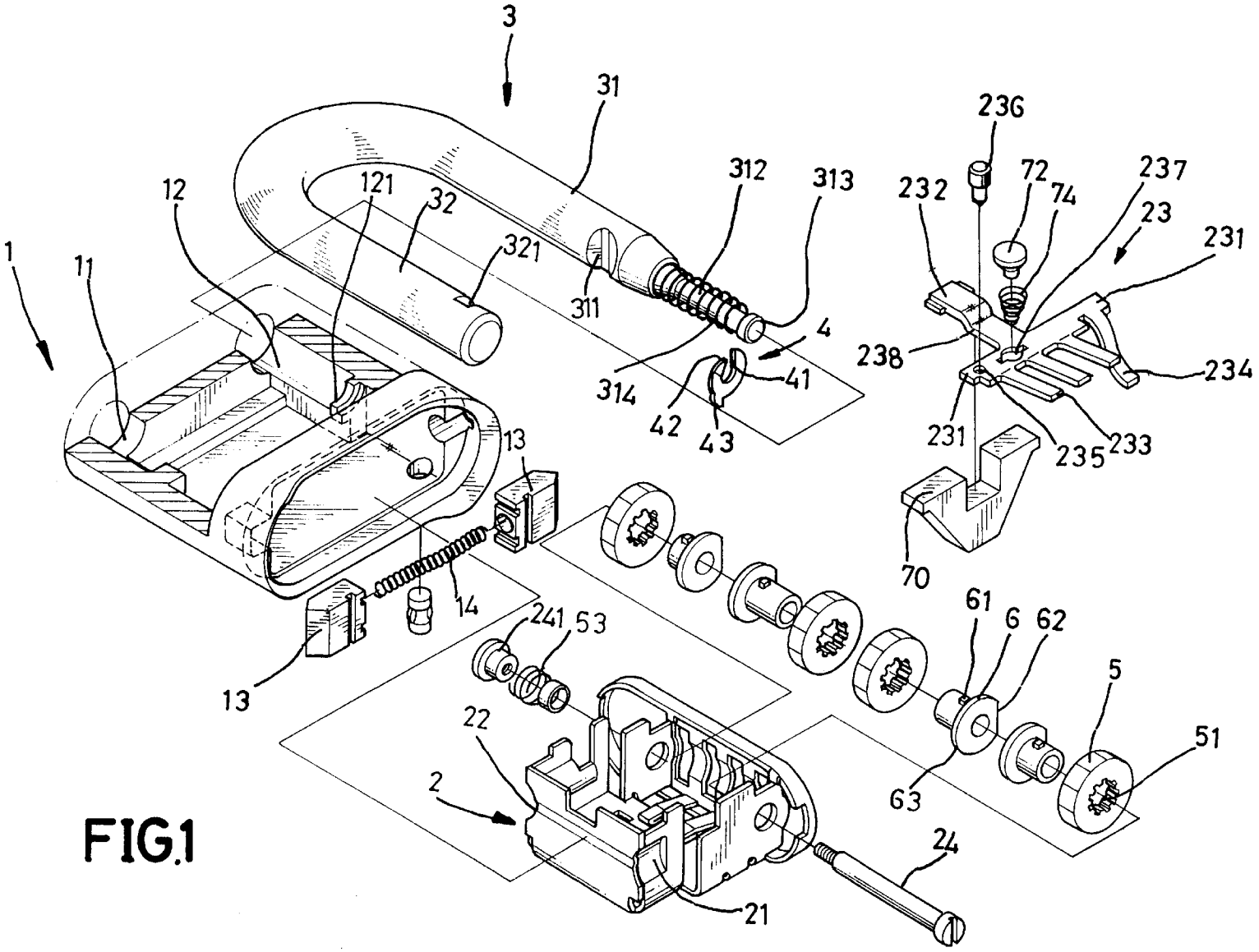
FIG. 1 is an exploded perspective view of a pad lock in accordance with the present invention.

Referring to FIG. 1, a pad lock in accordance with the present invention generally includes an outer casing 1, a lock main body 2, and a shackle 3. The shackle 3 includes a longer section 31 and a shorter section 32 that are respectively received in two receptacles 11 and 12 defined in the outer casing 1. The longer section 31 includes a spring 314 mounted around a reduced end section 312 thereof that has an enlarged distal end 313 of a diameter greater than the reduced end section 312. The spring 314 biases the shackle 3 upwardly away from the outer casing 1. Each section 31, 32 has a notch 311, 321, which will be described later.

Figure 2:
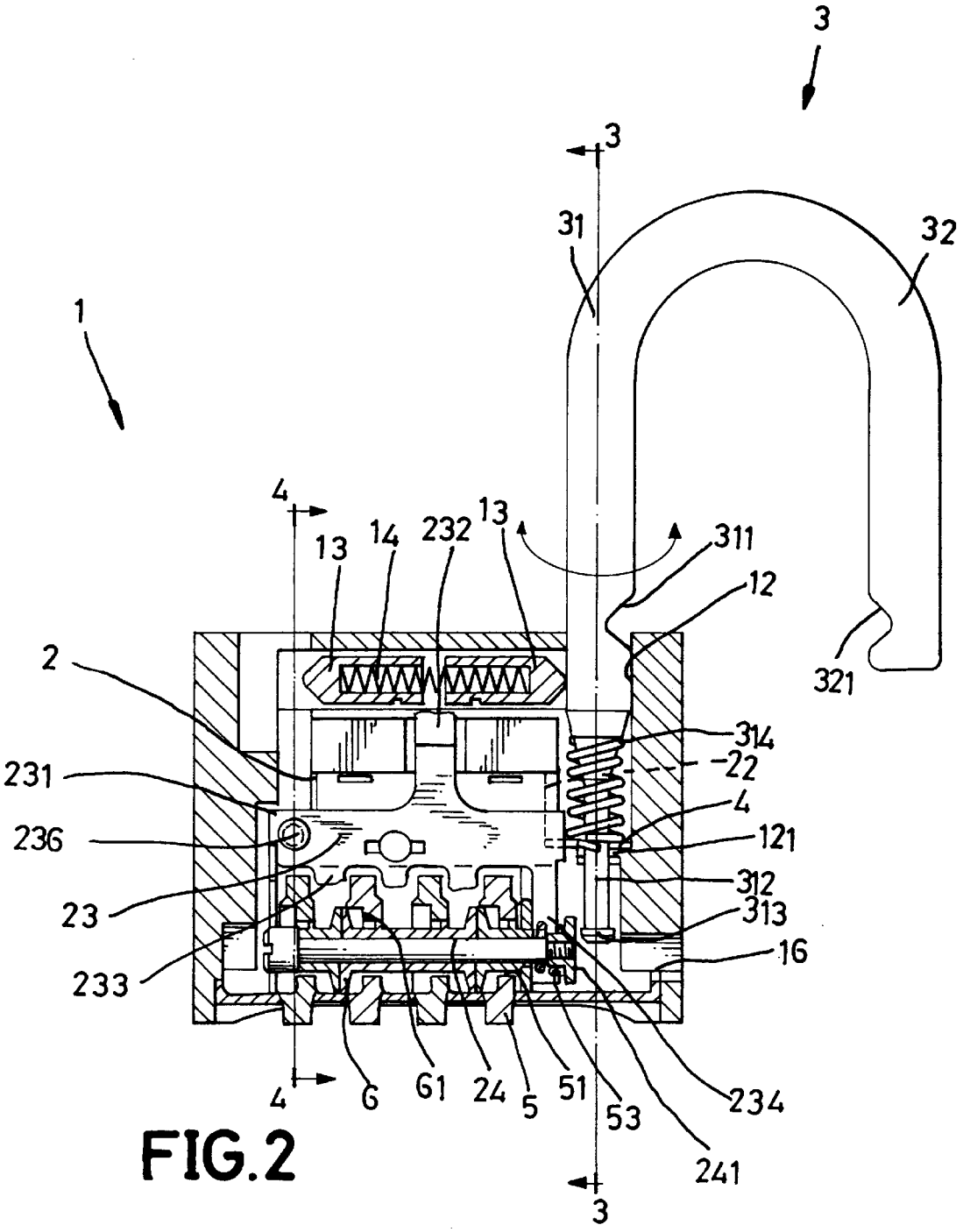
FIG. 2 is a sectional view of the pad lock in an unlocked status.

The lock main body 2 is mounted in the outer casing 1. A stem 24 is slidably extended through the lock main body 2 and includes an end block 241 threadedly engaged with a threaded end thereof. A groove 21, 22 is defined in each lateral side of the lock main body 2 to assist in positioning of the shackle sections 31 and 32. Several number wheels 5 are rotatably mounted around the stem 24. Also rotatably mounted around the stem 24 are several retaining sleeves 6 each of which includes a key 61 releasably engaged with a toothed hole 51 of an associated number wheel 5 to rotate therewith. Each retaining sleeve 6 further includes an enlarged circular end (not labeled) with a circular section 63 and a rectilinear section 62. As shown in FIGS. 1 and 2, a spring 53 is mounted around the stem 24 and between the end block 241 of the stem 24 and the rightmost retaining sleeve 6.

Two pin members 13 are mounted in the outer casing 1, and a spring 14 is provided to bias the pin members 13 to respectively engage with the notches 311 and 321 of the shackle 3 and thus retain the shackle 3 in a locked status, which is conventional and therefore not further described.

The lock main body 2 further includes a lever member 23 mounted therein. Two lateral sides 231 of the lever member 23 are retained in the lock main body 2. The lever member 23 includes a first end 232 and a number of spaced tongues 233 formed on a second end thereof The second end of the lever member 23 further includes a positioning member 234 formed thereon. The lever member 23 includes a recessed area 238 in a mediate section thereof for mounting a button 72 and a spring 74. The lever arm 23 is mounted to a substantially V-shaped block 70 at a section 238 thereof in a manner that the lever member 23 may sway about the block 70 like a teeterboard. The spring 74 biases the first end 232 of the lever member 23 to disengage from the pin members 13. A hole 235 is defined in a lateral side 231 of the lever member 23 that is distal to the positioning member 234. A safety pin 236 has a lower end anchored in the hole 235, which will be described later.

Figure 3:
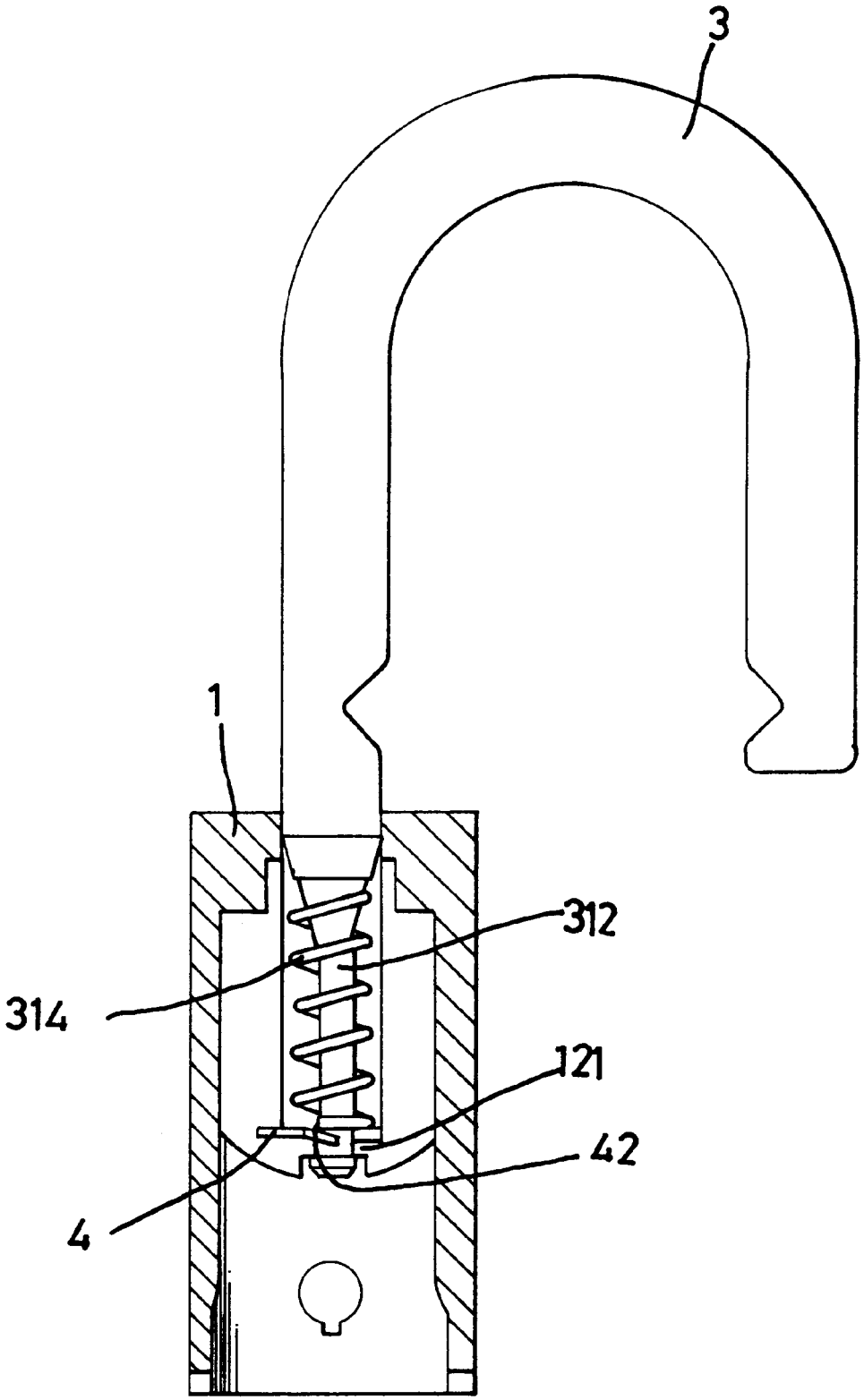
FIG. 3 is a sectional view taken along line 3—3 in FIG. 2.

Still referring to FIGS. 1 and 2, a protecting member 4 is mounted on an upper end wall of a retaining inner flange 121 formed in the receptacle 12. The protecting member 4 includes a tab 43 that bears against an inner wall of the outer casing 1 to retain the protecting member 4 in place. The protecting member 4 further includes a notch 41 through which the reduced end section 312 of the relatively longer section 31 is extended. The protecting member 4 further includes a guiding section 42 that is configured to guide the lower end of the spring 314 away from the flange 121. This prevents the lower end of the spring 314 from being stuck in the flange 121, as shown in FIG. 3. Thus, damage to the spring 314 during rotational movement of the shackle 3 is prevented. In addition, tilting of the shackle 3 is prevented by the protective member 4, as the reduced end section 312 of the shackle 3 is fittingly held by the notch 41 of the protective member 4, as shown in FIG. 2.

Figure 5:
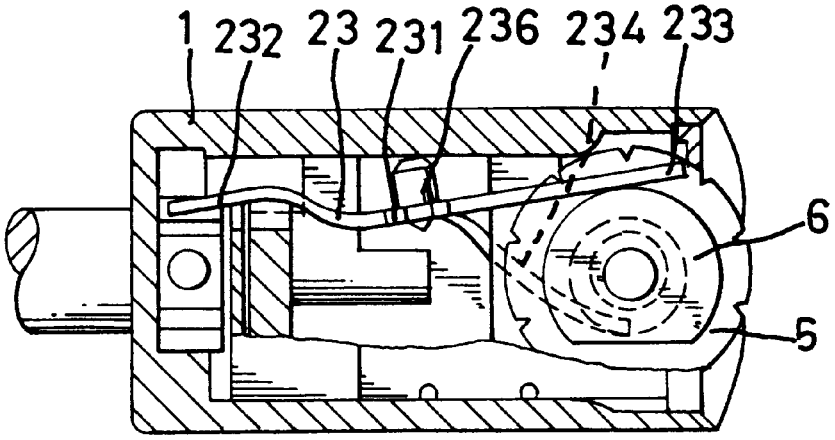
FIG. 5 is a sectional view similar to FIG. 4, illustrating function of the safety pin.
Figure 6:
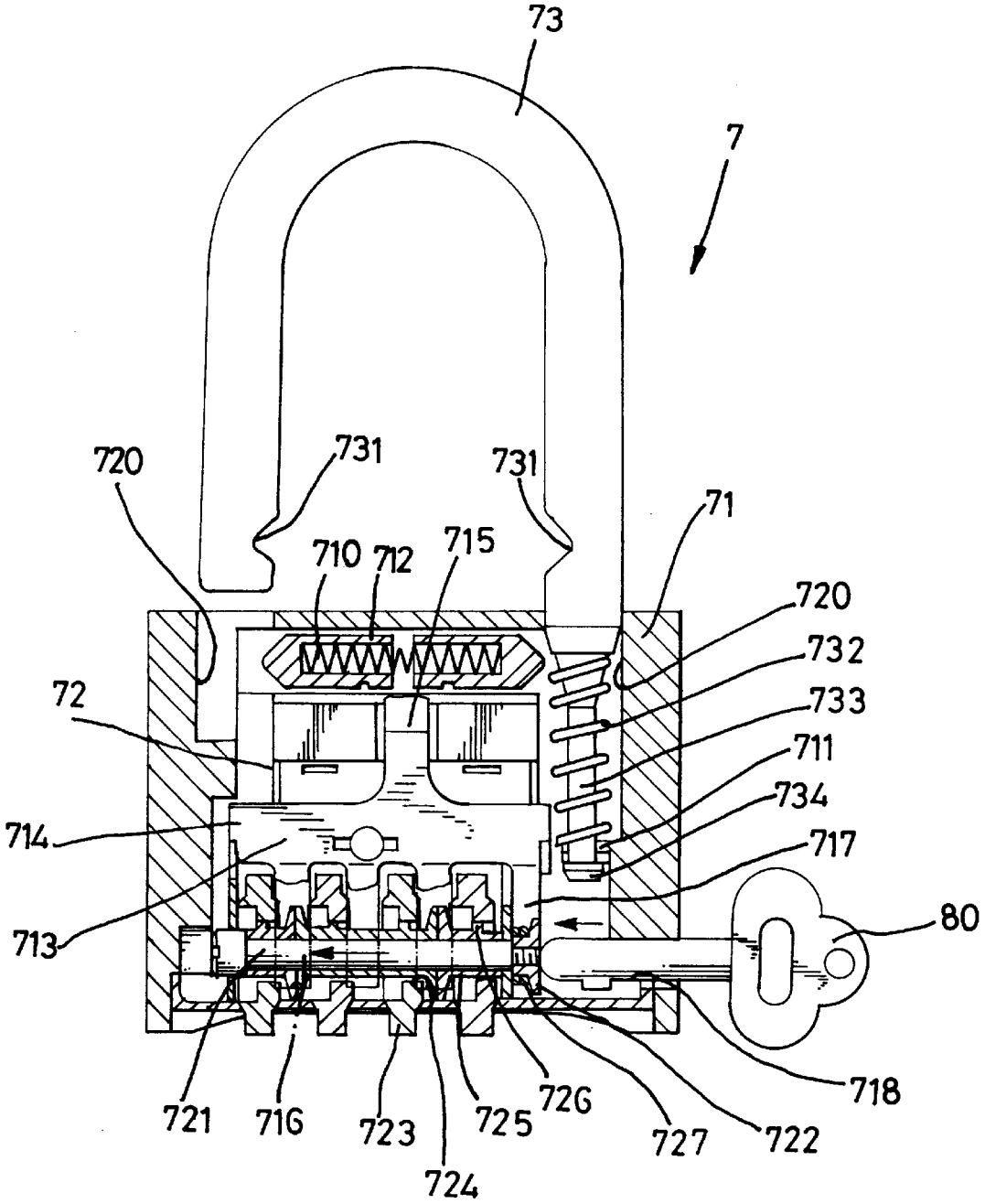
FIG.6 PRIOR ART
FIG. 6 is a sectional view of a conventional pad lock.
Figure 7:
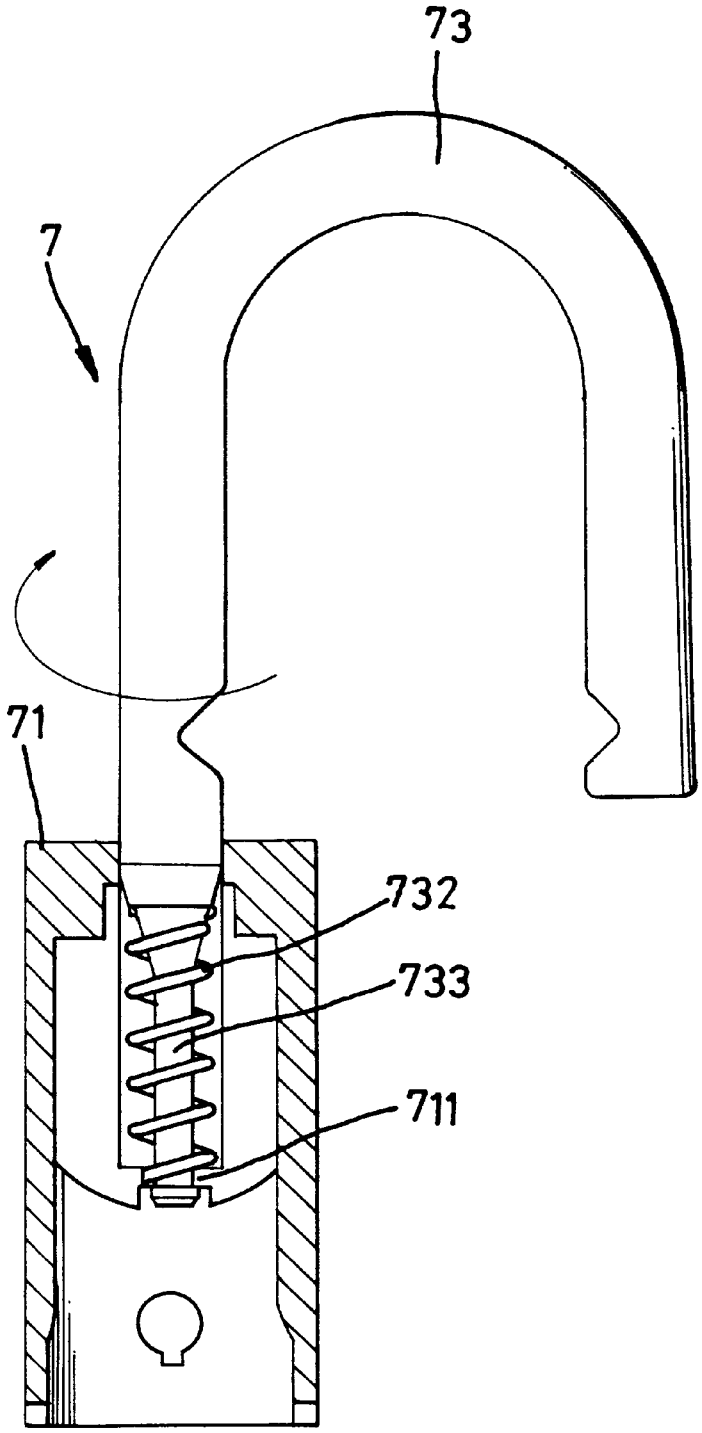
FIG.7 PRIOR ART
FIG. 7 is another sectional view illustrating a drawback of the spring of the conventional pad lock.
Figure 8:
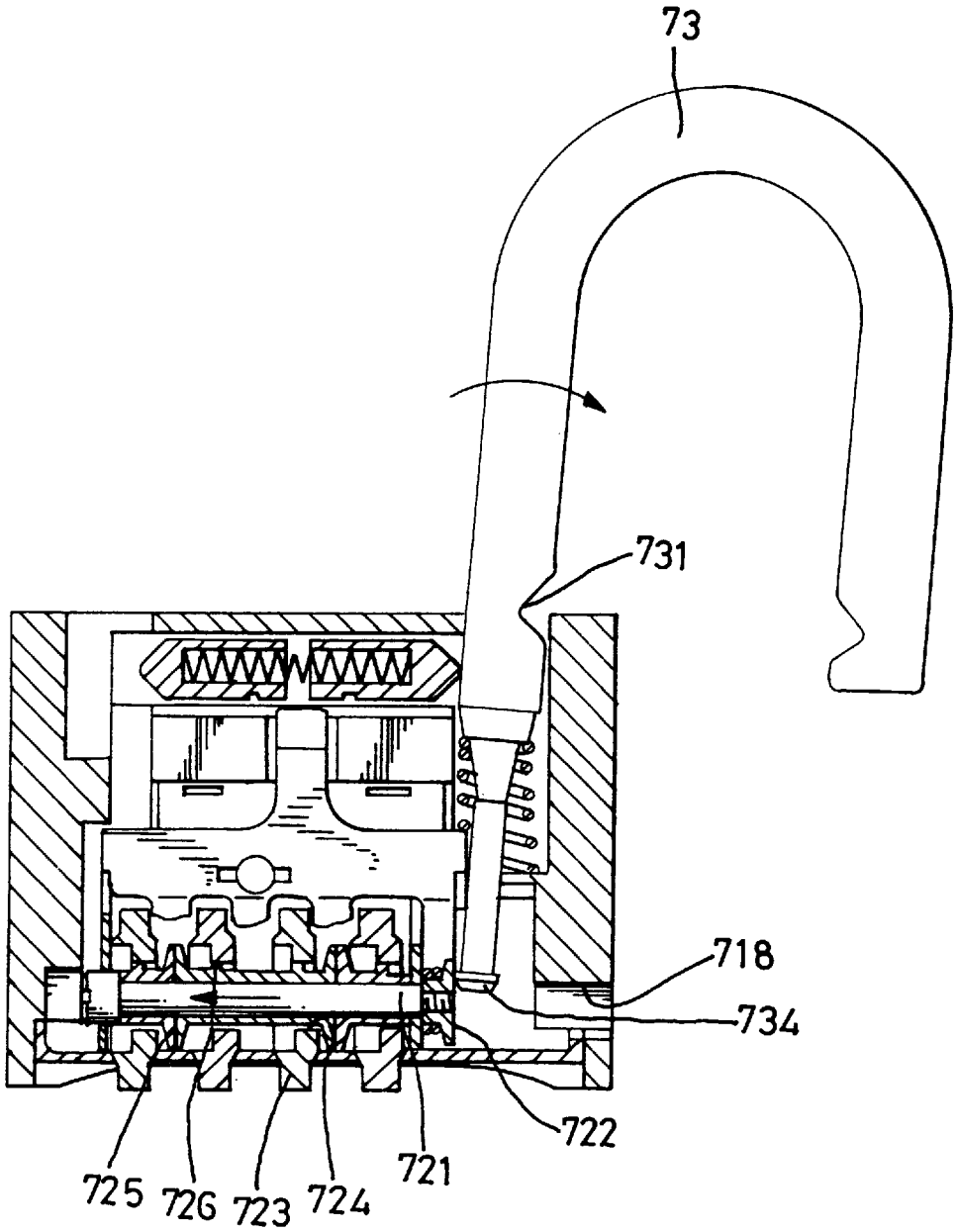
FIG.8 PRIOR ART
FIG. 8 is a sectional view similar to FIG. 6, illustrating an abnormal change in the code number of the conventional pad lock.
Figure 9:
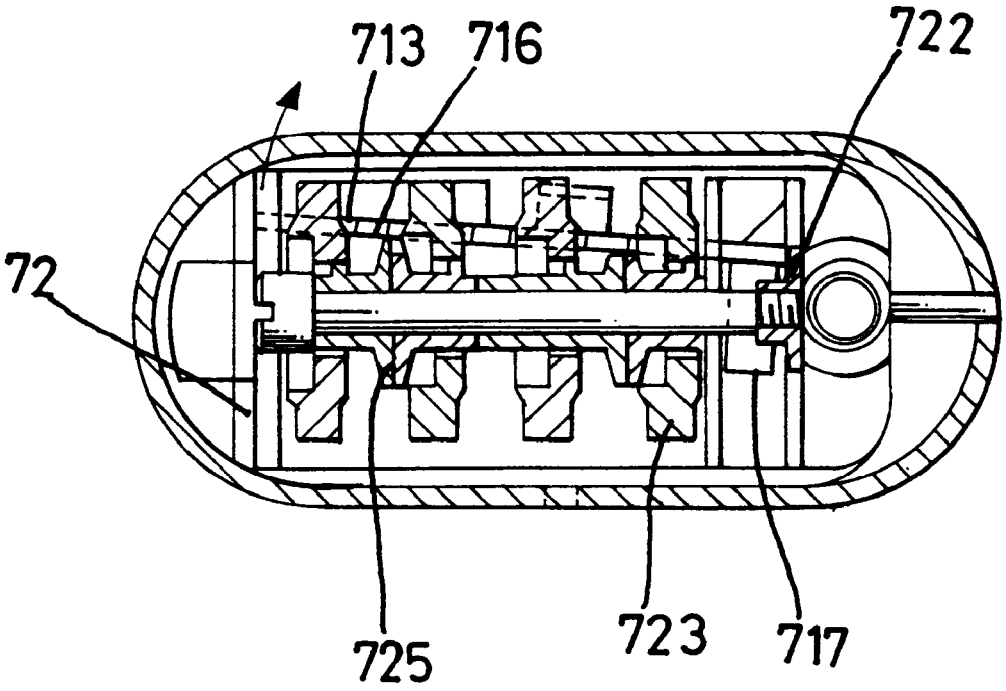
FIG 9 PRIOR ART
FIG. 9 is a further sectional view illustrating unreliable operation of a positioning member of the conventional pad lock.

Referring to FIG. 5, if any one of the number wheels 5 is not in the unlocking position (i.e., the code number is not matched), at least one tongue 233 will bear against the circular section 63 of the enlarged circular end of the associated retaining sleeve 6 and thus retain the first end 232 of the lever member 23 in a position between the pin members 13. Thus, the pin members 13 are moved outwardly to engage with the notches 311 and 321, respectively. It is appreciated that the positioning member 23 is reliably retained in a position that prevents from axial movement of the retaining sleeves 6 and the stem 24, as shown in FIG. 5. This is because the upper end of the safety pin 236 engages with and is thus stopped by the inner wall of the outer casing 1 to thereby prevent upward movement of the positioning member 234.

Figure 4:
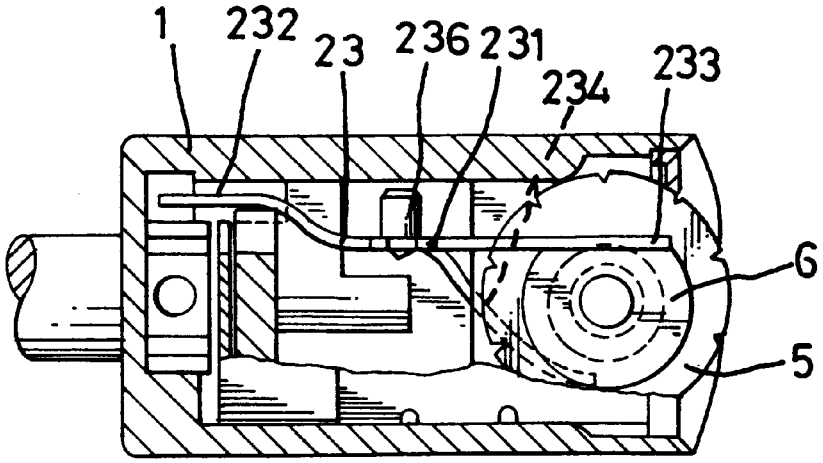
FIG. 4 sectional view taken along line 4—4 in FIG. 2, illustrating arrangement of a safety pin.

When all of the number wheels 5 are in the unlocking positions (i.e., the code number is matched), the tongues 233 bear against the rectilinear sections 62 of the associated retaining sleeves 6, as shown in FIG. 4. The first end 232 of the lever arm 23 disengages from the pin members 13 under the action of spring 14. The shackle 3 moves upwards under the action of the spring 314 and thus disengages from the pin members 13, as shown in FIG. 2. It is appreciated that the positioning member 23 is in a position that allows axial movement of the retraining sleeves 6 and the stem 24. If the user wants to set a new code number, he/she may insert an elongated member (not shown) via an opening 16 of the outer casing 1 to move the stem 24 and the retaining sleeves 6 axially. The key 61 on each retaining sleeve 6 disengages from the associated number wheel 5 and thus allows free rotation of the number wheel 5. Thus, the user may set the number wheels 5 to the required new code number. It is appreciated that the setting of the new code number can only be done under the unlocked status of the pad lock to prevent from manipulation of unauthorized people. The elongated member can be removed after setting of the new code number, and the retaining sleeves 6 and the stem 24 return to their initial positions under the action of the spring 53. The key 61 of each retaining sleeve 6 re-engages with the associated number wheel 5. Accordingly, the pad lock can be unlocked by a new code number from now on.

Although the invention has been explained in relation to its preferred embodiment, it is to be understood that many other possible modifications and variations can be made without departing from the spirit and scope of the invention as hereinafter claimed.

What is claimed is:

1. A pad lock comprising:

an outer casing including two receptacles, a periphery that defines one of the receptacles including a retaining annular flange formed thereon, the retaining annular flange includes an upper end wall and a lower end wall, a shackle including a longer section and a shorter section respectively received in the receptacles of the outer casing, at least one of the longer section and the shorter section including a notch defined therein, the longer section of the shackle including a reduced end section extended through the retaining annular flange, the reduced end section having an enlarged distal end bearing below the lower end wall of the retaining annular flange, a spring mounted around the reduced end section of the longer section of the shackle and including a lower end, the spring biasing the shackle upwardly to an unlocked status, a protective member secured to the upper end wall of the retaining annular flange, the protective member including a notch through which the reduced end section of the longer section of the shackle is rotatably extended, the protective member further including a guiding section that guides the lower end of the spring away from the retaining annular flange, at least one pin member mounted in the outer casing, means for biasing said at least one pin member to engage with the notch of the shackle to retain the shackle in a locked status, a stem slidably mounted in the outer casing, a plurality of number wheels rotatably mounted around the stem, a plurality of retaining sleeves mounted around the stem, each said retaining sleeve being releasably engaged with an associated said number wheel to rotate therewith, and a lever member including a first end releasably engaged with said at least one pin member to retain said at least one pin member in a position that engages with the notch of the shackle, the lever member further including a second end having a plurality of tongues, each said tongue being engaged with at least one of said retaining sleeves, the lever member further including a positioning member formed at the second end thereof, wherein the protective member prevents the enlarged distal end of the longer section of the shackle from engaging with the stem.

2. A pad lock comprising:

an outer casing including an inner wall and two receptacles, a shackle including a longer section and a shorter section respectively received in the receptacles of the outer casing, at least one of the longer section and the shorter section including a notch defined therein, means for biasing the shackle upwardly to an unlocked status, at least one pin member mounted in the outer casing, means for biasing said at least one pin member to engage with the notch of the shackle to retain the shackle in a locked status, a stem slidably mounted in the outer casing, a plurality of number wheels rotatably mounted on the stem, a plurality of retaining sleeves mounted on the stem, each said retaining sleeve being releasably engaged with an associated said number wheel to rotate therewith, and a lever member including a first end releasably engaged with said at least one pin member to retain said at least one pin member in a position that engages with the notch of the shackle, the lever member further including a second end having a plurality of tongues, each said tongue being engaged with at least one of said retaining sleeves, the lever member further including a positioning member formed at the second end thereof, the lever member including a hole defined in a lateral side thereof that is distal to the positioning member, a safety pin having a lower end anchored in the hole of the lever member and an upper end, wherein when any one of the number wheels is not in its unlocking position, the tongue engaged with the associated retaining sleeve is retained in a first position such that said first end of the lever member retains said at least one pin member to engage with the notch of the shackle while the upper end of the safety pin engages with and thus stopped by the inner wall of the outer casing to retain the positioning member in a position that prevents from axial movement of the stem and the retaining sleeves to thereby prevent from setting of a new code number, and wherein when all of the number wheels are in their unlocking positions, each said tongue engaged with the associated retaining sleeve is retained in a second position such that the first end of the lever member disengages from said at least one pin member, and the shackle moves upwardly to the unlocked position, while the positioning member is in a position that allows axial movement of the stem and the retaining sleeves to allow setting of the new code number.

* * * * *